United States Patent [19]

Adiletta

[11] 4,210,697

[45] Jul. 1, 1980

[54] PROCESS FOR PREPARING HYDROPHOBIC POROUS FIBROUS SHEET MATERIAL OF HIGH STRENGTH AND POROSITY AND PRODUCT

[75] Inventor: Joseph G. Adiletta, Thompson, Conn.

[73] Assignee: Pall Corporation, Glen Cove, N.Y.

[21] Appl. No.: 942,505

[22] Filed: Sep. 15, 1978

[51] Int. Cl.[2] ..... B32B 27/04

[52] U.S. Cl. ..... 428/272; 162/152; 162/156; 162/164 R; 162/168 R; 162/183; 427/244; 427/387; 428/273; 428/290

[58] Field of Search ..... 210/507; 427/244, 387; 204/295, 296; 428/272, 273, 290; 162/152, 156, 164 R, 168 R, 183

[56] References Cited

U.S. PATENT DOCUMENTS

| | | | |
|---|---|---|---|
| 3,053,762 | 9/1962 | Adiletta | 210/507 |
| 3,385,812 | 5/1968 | Brachman | 428/447 X |
| 3,723,264 | 3/1973 | Le Duc et al. | 204/295 X |
| 4,125,673 | 11/1978 | Roth et al. | 427/387 X |

FOREIGN PATENT DOCUMENTS

| | | | |
|---|---|---|---|
| 2301487 | 7/1973 | Fed. Rep. of Germany | 427/387 |

*Primary Examiner*—Evan K. Lawrence

[57] ABSTRACT

A process is provided for preparing hydrophobic porous fibrous sheet material suitable for use as a filter due to its inertness, strength, resistance to deterioration at elevated temperatures, and porosity, comprising impregnating a porous fibrous substrate with an aqueous dispersion consisting essentially of polytetrafluoroethylene or polytrifluorochloroethylene in an amount within the range from about 2 to about 40% by weight of the emulsion, and a silicone resin prepolymer such as a reactive polydimethylsiloxane in an amount within the range from about 0.1 to about 8% by weight of the emulsion; and drying the substrate at a temperature above about 525° F. to cure the silicone resin prepolymer, forming a hydrophobic polymer, and sinter-bond the polytetrafluoroethylene or polytrifluorochloroethylene thereto and to the substrate, thereby forming a hydrophobic porous fibrous sheet material that is inert, has a high strength, and a high resistance to deterioration at elevated temperature; each of the silcone polymer and polytetrafluoroethylene or polytrifluorochloroethylene unexpectedly synergizing the hydrophobicity and strength imparted to the substrate by the other. A hydrophobic porous fibrous sheet material also is provided, comprising a substrate of porous fibrous sheet material impregnated with a composition consisting essentially of polytetrafluoroethylene or polytrifluorochloroethylene and a silicone resin, said polytetrafluoroethylene or polytrifluorochloroethylene being sinter-bonded to the silicone resin and to the substrate, each of the silicone polymer and polytetrafluoroethylene or polytrifluorochloroethylene synergizing the hydrophobicity and strength imparted to the substrate by the other.

22 Claims, No Drawings

PROCESS FOR PREPARING HYDROPHOBIC POROUS FIBROUS SHEET MATERIAL OF HIGH STRENGTH AND POROSITY AND PRODUCT

BACKGROUND OF THE INVENTION

Adiletta U.S. Pat. No. 3,053,762, patented Sept. 11, 1962, provides a filter material having a substrate of woven, inert cloth, such as glass, upon which other fibers, such as glass, are deposited in a controlled blend and quantity and locked firmly to the substrate. The resulting sheet material is impregnated with a thermoplastic material such as polytetrafluoroethylene, polytrifluorochloroethylene or a silicone-type resin to impart special characteristics to the material. The material is then dried and cured or fused to fix the impregnant thereon. Several types and thicknesses of woven cloth may be employed as the substrate, and the pore sizes of the material may be predetermined and controlled by the type and amount of glass fibers applied thereto.

Polytetrafluoroethylene and, to a lesser extent, polytrifluorochloroethylene render the substrate hydrophobic, and impart high strength and inertness, as well as resistance to deterioration at elevated temperatures, because of the high softening point of these polymers. Silicone-type resins also impart hydrophobicity to the substrate, and resistance to deterioration at elevated temperatures, after curing of the polymer, but do not impart high strength.

SUMMARY OF THE INVENTION

In accordance with the invention, it has now been determined that both silicone resin prepolymer capable of being cured to a hydrophobic polymer and polytetrafluoroethylene or polytrifluorochloroethylene when applied together impart a hydrophobicity and strength to the substrate that is far more than additive, and is therefore synergistic. A controlled porosity can be obtained, and the resulting product is also inert, so that it is accordingly far superior to the products obtained using either impregnant alone.

The process in accordance with the invention comprises impregnating a porous fibrous substrate with an aqueous dispersion consisting essentially of polytetrafluoroethylene or polytrifluorochloroethylene in an amount within the range from about 2 to about 40%, preferably from about 3 to about 15%, by weight of the emulsion, and a silicone resin prepolymer in an amount within the range from about 0.1 to about 8%, preferably from about 0.2 to about 1%, by weight of the emulsion; and drying the substrate at a temperature above about 525° F. to cure the silicone resin prepolymer, forming a hydrophobic polymer, and sinter-bond the polytetrafluoroethylene or polytrifluorochloroethylene thereto and to the substrate, thereby forming a hydrophobic porous fibrous sheet material that is inert, has a high strength and a high resistance to deterioration at elevated temperature; each of the silicone polymer and polytetrafluoroethylene or polytrifluorochloroethylene synergizing the hydrophobicity and strength imparted to the substrate by the other.

At amounts of polytetrafluoroethylene or polytrifluorochloroethylene in excess of 15%, ranging up to about 40%, and at amounts of silicone resin prepolymer in excess of 5%, ranging up to about 8%, higher strength is obtained, at a trade-off of reduced porosity, without appreciable change in hydrophobicity.

A hydrophobic porous fibrous sheet material also is provided, comprising a substrate of porous fibrous sheet material impregnated with a composition consisting essentially of a polytetrafluoroethylene or polytrifluorochloroethylene and a silicone resin, said polytetrafluoroethylene or polytrifluorochloroethylene being sinter-bonded to the silicone resin and to the substrate, each of the silicone polymer and polytetrafluoroethylene or polytrifluorochloroethylene synergizing the hydrophobicity and strength imparted to the substrate by the other.

DESCRIPTION OF THE PREFERRED EMBODIMENTS

The impregnation step of the process of the invention can be applied to a preformed fibrous substrate, such as a woven or nonwoven sheet material, cloth or fabric, web or batt, as well as to the fibrous material of which such sheet material is formed, prior to sheet formation. Thus, for example, the aqueous dispersion can be blended with a slurry of fibrous material, and then formed into a sheet material, as a result of which the sheet material is impregnated by the aqueous dispersion in situ in the course of its formation.

The substrate can be fully or partially impregnated. Under some circumstances, an impregnation extending only part way through the substrate may suffice. The extent of impregnation can be controlled by restricting the impregnation time, or by squeezing, or by increasing the viscosity of the impregnating dispersion.

Slurrying of the fibrous material in the impregnating dispersion can result in a more uniform distribution of the polymers on the fibrous surfaces and in the interstices between the fibers. However, aqueous dispersions of polytetrafluoroethylene or polytrifluorochloroethylene and silicone resin prepolymer have improved wetting characteristics for both hydrophilic and hydrophobic substrates, and it is accordingly possible to impregnate substantially completely all of the open space in such materials, and distribute the impregnant throughout the pores. Frequently, complete impregnation is difficult when the base material is of a hydrophobic fibrous material, because such materials tend naturally to repel hydrophilic materials, such as aqueous dispersions of the impregnants employed in the process of the invention, and restrict their entry into the pores, especially when the pores are of microscopic dimensions. However, an aqueous dispersion of both of these polymers appears to have better wetting properties for such materials than aqueous dispersions of either impregnant, taken alone.

The fibrous material to which the process of the invention is applicable can be any fibrous material that can withstand heating to 650° F. and higher, according to the curing temperature selected. The material can be hydrophilic, such as glass and quartz, or hydrophobic, such as mineral wool, stainless steel, silica, titania, carbon and boron oxide fibers. These fibers can, as indicated, be loose, and also dispersed in the aqueous suspension of the impregnants, from which slurry the sheet material can be formed by laydown on a Fourdrinier wire or other web-forming procedure, as well as preformed into a woven or nonwoven sheet material. The woven materials can be woven in any type of weave, such as square weave, twill weave, and Dutch twill weave, and also include knotted and knitted materials.

The substrate can have one or several layers of the same or different fibrous material. A particularly preferred substrate is a woven cloth or textile to which is applied loose fibrous material, as in the composites of U.S. Pat. No. 3,053,762. In this case, a woven glass cloth with glass fibrous material attached thereto is a preferred type.

Any polytetrafluoroethylene or polytrifluorochloroethylene polymer can be used. The material should be in finely-divided form, and preferably as an aqueous dispersion. Emulsifiers and wetting agents can be incorporated in the dispersion, to improve its stability, and to improve the wetting of the substrate, particularly where the substrate is of hydrophobic material.

Any silicone resin prepolymer i.e., a silicone resin in a partially polymerized state, or in an incomplete stage of polymerization, can be used, and cured in situ optionally with the aid of a catalyst, after application to the substrate. The material should be in finely-divided form, and preferably as an aqueous dispersion or emulsion. Emulsifiers and wetting agents also can be incorporated in such aqueous dispersions or emulsions.

Silicone polymers are polysiloxanes, made up of terminal

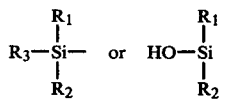

groups attached at each end of a chain of recurring monomer units of the type

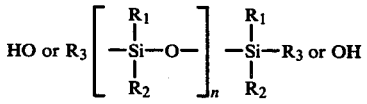

where:

(a) $R_1$, $R_2$ and $R_3$ are hydrocarbon groups, and (b) n is a number representing the number of units in the polymer.

Most polymers are of course formed of varieties of species with different n values, and the molecular weight represents an average molecular weight for the types of species present.

As the hydrocarbon groups, aliphatic, aromatic and cycloaliphatic hydrocarbon groups can be used, both unsubstituted and substituted, with inert substituents such as, chlorine, fluorine, nitro, carboxylic ester and hydroxyl groups. Halogen groups if attached directly to the silicon atom are active, but when attached to the hydrocarbon substituent are inert.

A silicone resin prepolymer has a relatively low value of n, with active terminal groups, having a labile halogen or hydrogen atom, and is susceptible of further polymerization by linkage of the terminal ends of small chains together at the reactive sites. Such reactions are favored in the presence of a catalyst and at elevated temperature, and any known catalyst for the reaction can be used.

A silicone resin prepolymer that is preferred because of its ready availability and ease of application is polydimethyl siloxane. However, other silicone resin prepolymers can be used, including polymethylethyl siloxane, polydiethyl siloxane, polydipropyl siloxane, polydihexyl siloxane, polydiphenyl siloxane, polyphenylmethyl siloxane, polydicyclohexyl siloxane, polydicyclopentyl siloxane, polymethylcyclopentyl siloxane, polymethylcyclohexyl siloxane, polydicycloheptyl siloxane, and polydicyclobutyl siloxane.

The polytetrafluoroethylene and polytrifluorochloroethylene polymers are available commercially in the form of aqueous dispersions or emulsions ready for use as impregnants for textile materials, and so also are silicone resin prepolymers, in which case the commercially available dispersions or emulsions also include catalysts for the cure of the polymer after application. Such aqueous dispersions and emulsions are for the most part mutually compatible, and consequently the aqueous dispersions and emulsions for application to a porous fibrous substrate in accordance with the invention can easily be prepared simply by blending two commercially available dispersions or emulsions of each impregnant. If the resin concentration in either or both is too high, the dispersions or emulsions can be diluted with water before or after they are mixed together. Mixtures of polytetrafluoroethylene and/or polychlorotrifluoroethylene polymers and of silicone resin prepolymers can be used, if desired, for special effects.

The dispersion or emulsion can be applied to the substrate by any conventional textile application or treating method, including impregnating by dipping the substrate in a tank or reservoir of aqueous dispersion or emulsion, or by spraying the aqueous dispersion or emulsion on the substrate, or by applying the dispersion or emulsion to the substrate by kissing rolls, or by spreading or coating the dispersion or emulsion on the substrate from a head box, optionally with the aid of a doctor blade. After application, the substrate can be squeezed or pressed, if the amount of take-up is excessive, but normally it is less complicated to simply adjust the concentration of the impregnants in the dispersion so that pick-up of the dispersion obtained in application gives the desired weight of resins per unit volume after drying.

After application of the dispersion or emulsion and impregnation to the desired extent, ranging from about 5% to about 100%, i.e., in a manner such that the substrate is substantially saturated therewith, if the 100% pick-up technique is being applied, or less, if penetration is restricted and/or a squeezing step is introduced, the impregnated material is dried and cured. The curing of the silicone polymer requires application of heat at a temperature in excess of about 250° F. in most cases, but higher temperatures can be used, of 620° F. and higher.

Accordingly, the silicone polymer can first be cured by application of an elevated temperature at or above the recommended minimum.

However, it is also important to sinter-bond the polytetrafluoroethylene or polytrifluorochloroethylene so as to anchor it to the substrate and to the silicone polymer, and this requires that the impregnated substrate be heated to a temperature at or above the softening, melting or fusing temperature of the polytetrafluoroethylene or polytrifluorochloroethylene. Polytetrafluoroethylene sinters at about 620° F. and above, and polytetrafluorochloroethylene sinters at 525° F. and above. Accordingly, the impregnated substrate must also be heated at a temperature above this minimum temperature, for sinter-bonding.

Since the silicone polymer will also cure at this temperature, it is usually most convenient simply to heat the impregnated substrate at a temperature above this minimum temperature for a sufficient time both to sinter-bond both the polytetrafluoroethylene and polytrifluorochloroethylene and cure the silicone polymer. Since the curing of the silicone polymer and the sinter-bonding are both rapid, and are complete usually within a few minutes time, only a short heating is required.

After cooling, the finished product can be rolled up, or cut into selected lengths, and is then ready for use.

The product has a remarkable hydrophobicity, which is retained after repeated wettings, a surprising property that is not found in substrates that are simply treated with polytetrafluoroethylene or polychlorotrifluoroethylene polymer or silicone polymer alone. Silicone polymers tend to retain hydrophobicity until the first wetting, but after that wetting, it is very difficult to restore full hydrophobicity to the substrate, even by heating at an elevated temperature. This is not true of the products of the instant invention, which can be wetted repeatedly, and after drying will be found to have their previous hydrophobicity fully restored.

Accordingly, the products in accordance with the invention are particularly suitable for use as vent filter media in medical applications, where they may be wet through without injury, and when dry will again pass gases but not aqueous liquids. Thus, for example, they are particularly useful as air-admitting or air-discharging vents in intravenous administration apparatus, where, for example, they may be required to permit air to escape from a container, or permit air to enter, without passing aqueous liquids therethrough. They can also be used as urinary bags, and will permit air to escape from the bag as it is being filled, but not the liquid.

Inasmuch as the pore size can be controlled so as to be less than 1 micron, and even less than 0.3 micron, the products also serve as barrier filters for air-borne bacteria. For example, in urinary bags they will permit air to escape, but keep the liquid and bacteria in. In use as a filter across an air vent in an intravenous administration kit, any air that enters through the material will be free of air-borne bacteria.

Because of their high porosity, they are of particular utility as filter media for use in hydraulic systems, gas pump filters, filter presses, light-weight filters (replacing metal screens and porous metal), as well as in filter uses where it is necessary to separate gases from aqueous liquids or other hydrophilic liquids, or hydrophilic liquids from hydrophobic liquids, such as water and oil. Since they are hydrophobic, the materials of the invention will permit hydrophobic liquids to pass through, but will repel and therefore prevent passage of hydrophilic liquids. They are consequently useful as barrier filters in the devices of U.S. Pat. No. 3,520,416 to Keedwell, patented July 14, 1970, No. 3,523,408 to Rosenberg, patented Aug. 11, 1970, and No. 3,631,654 to Riely and Skyles, patented Jan. 4, 1972.

The following Examples in the opinion of the inventor represent preferred embodiments of the invention:

EXAMPLES 1 and 2

A continuous strip of woven cloth of glass or mineral wool fiber about 10 mils thick was carried over the belt assembly 14 of the apparatus shown and described in FIG. 3 of U.S. Pat. No. 3,053,762 as the continuous strip 10 of woven cloth. From the head box 22 was deposited on the cloth a layer 5 mils thick, an aqueous slurry of glass fibers 1.0 mm long and 0.001 mm in diameter, after which the composite was passed over a vacuum box so that the fibers of the slurry were firmly locked onto the cloth, while the slurrying fluid was sucked through the cloth, and withdrawn.

The substrate was divided into two strips and to each of these strips were then applied one of the aqueous dispersions whose composition is given in the following Table I. Each of these dispersions contained polytetrafluoroethylene and silicone resin prepolymer, and the dispersions were prepared by blending commercially available polytetrafluoroethylene aqueous dispersion and aqueous silicone prepolymer dispersion in the amounts required to give the aqueous dispersion whose resin content appears in Table I. The polytetrafluoroethylene dispersion was Du Pont's TEFLON 30B at 8% solids W/W.

The silicone resin prepolymer dispersion was reactive polydimethyl siloxane of 150 cp viscosity plus 5% catalyst in water emulsion to 1% solids.

The dispersions were applied to the glass fiber glass cloth composite by passing the strip through an impregnating bath of the dispersion as shown in FIG. 3 of U.S. Pat. No. 3,053,762. Table I sets out the percent pick-up by weight of the impregnants. The material was then passed through a temperature-controlled oven at 700° F., the passage time being about three minutes, whereupon the silicone resin was cured and the polytetrafluoroethylene sinter-bonded to the resin and to the composite substrate.

Hydrophobicity of the resulting substrate was then evaluated by interposing a 3 cm by 3 cm square piece of the product across the line of upward flow of water under pressure, and the pressure required to force the water through the product was then determined as inches of water column. The results obtained for each of the products appear in Table I.

The porosity of the product after impregnation and before impregnation was also determined by the Gurley test method.

The following results were obtained.

TABLE I

| Example No. | % By Weight: Polytetrafluoroethylene | % By Weight: Silicone polymer | % Pick-up of polytetrafluoroethylene % by weight of the substrate plus impregnant | Inches of Water Column | Gurley Test (secs/vol): Porosity before impregnation | Gurley Test (secs/vol): Porosity after impregnation |
|---|---|---|---|---|---|---|
| 1 | 6.5 | 2.5 | 19.8 | 55/60 | 7.6 | 20.1/27.7 |
| 2 | 2.0 | 0.5 | 6.2 | 55/60 | 8.1 | 9.8/11.4 |
| Control 1 | 6.5 | — | 17.7 | 30 | 7.6 | 24 |
| Control 2 | 2.0 | — | 6.2 | 20 | 8.1 | 10 |
| Control 3 | — | 10.0 | * | 30 | 1.3 | 1.3 |

* not measurable, less than 1%

It is apparent from the results for the controls that the hydrophobicity of the product containing both polytetrafluoroethylene and silicone polymer is very significantly more than that of the product containing only one of these impregnants, showing that more than additive results are obtained, and that therefore the effect is synergistic.

EXAMPLES 3 and 4

A slurry of glass fibers 0.5 micron in diameter was prepared then formed on a paper-making machine, thereby forming a glass fiber paper 6 mil thick.

To this paper were applied aqueous dispersions of polytetrafluoroethylene, or silicone resin prepolymer, and of both polytetrafluoroethylene and silicone resin prepolymer prepared by blending the commercially-available aqueous dispersions of these materials described in Example 1 in the amounts required to give the proportions indicated in Table II below.

Application of the aqueous dispersions was in accordance with the technique described in Example 1. The aqueous dispersion was placed in an impregnating bath reservoir, and applied to the glass fiber mat by dipping, passing the mat through the bath as shown in FIG. 3 of U.S. Pat. No. 3,053,762. The impregnated material was then cured and dried at 750° F.

The resulting material was evaluated for tensile strength, for porosity in terms of pressure drop in inches of water column, and for hydrophobicity in terms of inches of water column, using the test procedures described in connection with Examples 1 and 2.

The following results were obtained:

TABLE II

| Example No. | % By Weight Polytetrafluoroethylene | % By Weight Silicone polymer | % Pick-up of polytetrafluoroethylene % by weight of the substrate plus impregnant | Tensile strength (g pi) | Hydrophobicity (Inches of Water Column) | Porosity Δp wc/28 |
|---|---|---|---|---|---|---|
| Control 3 | — | 0.1 | 0 | 30 | 30 | 1.4 |
| Control 4 | — | 10.0 | 0 | 30 | 30 | 1.3 |
| Control 5 | 5 | — | 12 | 400 | 17 | 6.0 |
| 3 | 15 | 0.1 | 20 | 50 | 36 | 1.3 |
| 4 | 5 | 0.5 | 11.2 | 400 | 76 | 7.0 |

It is apparent from the results that the products containing both polytetrafluoroethylene and silicone polymer were far more hydrophobic than the Controls, and the hydrophobicity was more than additive, as is apparent from comparison of Controls 4 and 5 with Example 4.

Having regard to the foregoing disclosure, the following is claimed as inventive and patentable embodiments thereof:

1. A process for preparing a hydrophobic porous fibrous sheet material which comprises impregnating a substrate of porous fibrous sheet material with an aqueous dispersion consisting essentially of at least one polymer selected from the group consisting of polytetrafluoroethylene and polytrifluorochloroethylene in an amount within the range from about 2 to about 40% by weight of the emulsion, and a silicone resin prepolymer in an amount within the range from about 0.1 to about 8% by weight of the emulsion; and drying the substrate at a temperature above about 525° F. to cure the silicone resin prepolymer, forming a hydrophobic polymer, and sinter-bond the polytetrafluoroethylene or polytrifluorochloroethylene thereto and to the substrate, thereby forming a hydrophobic porous fibrous sheet material that is inert, has a high strength and a high resistance to deterioration at elevated temperature; each of the silicone polymer and polytetrafluoroethylene or polytrifluorochloroethylene synergizing the hydrophobicity and strength imparted to the substrate by the other.

2. A process in accordance with claim 1, in which the substrate is a preformed fibrous substrate selected from the group consisting of woven and nonwoven sheet material, cloth and fabric, mats, webs and batts.

3. A process in accordance with claim 1, in which said substrate is impregnated by mixing the polymer and prepolymer with the fibrous material of which the substrate is to be formed and then forming the substrate of impregnated porous fibrous sheet material.

4. A process in accordance with claim 3, in which said mixing is carried out by blending an aqueous dispersion of said polymer and prepolymer with a slurry of the fibrous material of which the substrate is to be formed and then forming said sheet material.

5. A process in accordance with claim 1, in which the fibrous material is hydrophilic.

6. A process in accordance with claim 5, in which the hydrophilic fibrous material comprises synthetic fibers.

7. A process in accordance with claim 1, in which the fibrous material is hydrophobic.

8. A process in accordance with claim 7, in which the hydrophobic fibrous material comprises inorganic fibers.

9. A process in accordance with claim 8, in which the inorganic fibers are glass or mineral wool.

10. A process in accordance with claim 1, in which the polymer is polytetrafluoroethylene.

11. A process in accordance with claim 1, in which the polymer is polytrifluorochloroethylene.

12. A process in accordance with claim 1, in which the silicone resin prepolymer is a polysiloxane.

13. A process in accordance with claim 12, in which the polysiloxane is polydimethyl siloxane.

14. A process in accordance with claim 1, in which the dispersion is applied to the substrate by dipping the substrate in a body of aqueous dispersion.

15. A process in accordance with claim 1, in which the dispersion is applied to the substrate by spraying the aqueous dispersion on the substrate.

16. A process in accordance with claim 1, in which the dispersion is applied to the substrate by kissing rolls.

17. A process in accordance with claim 1, in which the dispersion is applied to the substrate by spreading or coating the dispersion on the substrate.

18. A process in accordance with claim 1, in which the curing of the silicone polymer is effected by heating the impregnated material at a temperature in excess of about 250° F., and then the polymer is sinter-bonded at a temperature above about 620° F.

19. A hydrophobic porous fibrous sheet material comprising a composition consisting essentially of a substrate of porous fibrous sheet material impregnated with a polymer selected from the group consisting of polytetrafluoroethylene and polytrifluorochloroethylene in an amount within the range from about 3% to about 15%, and a silicone resin in an amount within the range from about 0.1% to about 8%, said polytetrafluoroethylene or polytrifluorochloroethylene being sinter-bonded to the silicone resin and to the substrate, each of the silicone polymer and polytetrafluoroethylene or polytrifluorochloroethylene synergizing the hydrophobicity and strength imparted to the substrate by the other.

20. A hydrophobic porous fibrous sheet material in accordance with claim 19 in which the polymer is polytetrafluoroethylene.

21. A hydrophobic porous fibrous sheet material in accordance with claim 19 in which the polymer is polytrifluorochloroethylene.

22. A hydrophobic porous fibrous sheet material in accordance with claim 19 in which the silicone polymer is a polysiloxane.

* * * * *